US005857876A

United States Patent [19]

Hatagishi

[11] Patent Number: 5,857,876

[45] Date of Patent: Jan. 12, 1999

[54] CONNECTOR TERMINAL LOCK STRUCTURE

[75] Inventor: Yuji Hatagishi, Shizuoka, Japan

[73] Assignee: Yazaki Corporation, Tokyo, Japan

[21] Appl. No.: 832,665

[22] Filed: Apr. 4, 1997

[30] Foreign Application Priority Data

Apr. 8, 1996 [JP] Japan ..... 8-085264

[51] Int. Cl.[6] ..... H01R 13/514

[52] U.S. Cl. ..... 439/752; 439/595

[58] Field of Search ..... 439/595, 752, 439/466, 468, 744, 456, 460

[56] References Cited

U.S. PATENT DOCUMENTS 5,380,220 1/1995 Okabe ..... 439/595 X 5,573,432 11/1996 Hatagishi ..... 439/752

5,681,184 10/1997 Pamart et al. ..... 439/595

*Primary Examiner*—Khiem Nguyen

*Attorney, Agent, or Firm*—Sughrue, Mion, Zinn, Macpeak & Seas, PLLC

[57] ABSTRACT

The connector terminal lock structure 1 includes the connector housing main body 2 that includes a plurality of terminal accommdating chambers 5 and the cover 3 that covers the housing main body 2, is provided with the lock projections 8 on both inner sides of the side walls 6 so as to confront one another for prevention of backward disengagement of the connection terminals 4, the protruding part 9 at front end of the bottom wall 7 of the terminal accommdating chambers 5 for prevention of forward disengagement of the connection terminals 4, the spaces 12 between the lock projections 8 and the bottom wall 7 for prevention of upward disengagement of the connection terminals 4 and the seal component 13 made of rubber on the rear end of the housing main body 2 to be inserted between the housing main body 2 and the cover 3.

8 Claims, 4 Drawing Sheets

52
53
55
32
56
40
47
33
42
39
44
54
54
41
38
36
45
4
14
35
W
46
50
31

CONNECTOR TERMINAL LOCK STRUCTURE

BACKGROUND OF THE INVENTION

1. Field of the Invention

The present invention relates to a connector terminal lock structure which can positively prevent connection terminals inserted into the inside of a connector from being incompletely stored in terminal accommodating chambers.

2. Related Art

A variety of connector terminal lock structures have been known, such as the one disclosed in Unexamined Japanese Utility Model Publication Hei. 3-20880.

FIG. 7 is a vertical sectional view of a conventional connector terminal lock structure. As FIG. 7 shows, a terminal lock structure 31 of a connector 40 consists of a housing main body 32 which includes a plurality of terminal accommodating chambers 35 and a cover 33 which covers a housing main body 32 wherein terminals 4 are stored. Flexible latches 38 to be locked in latch engagement recesses in top plates of the terminals 4 are provided on the inner surfaces of upper walls 36 of the terminal accommodating chambers 35.

A lock member 42, which forms front walls 39 of the terminal accommodating chambers 35 for prevention of forward disengagement of the terminals 4 and includes lock retaining plates 41 for prevention of incomplete locking and unlocking of the latches 38, is provided by insertion from the front as a member separated from the housing main body 32. A plurality of guide holes 44 for insertion of mating male terminals 54 of the terminals 4 are formed in the front walls 39.

A rectangular-plate-shaped packing member 45 made of an elastic material, such as rubber, and a locking projection piece 46 on the external side thereof are inserted between the rear end surface of the housing main body 32 and the cover 33 for prevention of water seepage into the terminal accommodating chambers 35. A plurality of through holes 14 for insertion of covered wires W penetrate the packing member 45. Channels 47 for leading out the covered wires W are formed on the cover 33.

A mating connector 50 is provided with a mating connector housing 52 which retains a plurality of male terminals 54 and which is inserted into and connected with the housing main body 32 from the front and also provided with a mating connector cover 53 which covers the mating connector housing main body 52 via a packing member 55. A packing member 56 for prevention of water seepage is provided in a space between the housing main body 32 to be connected with and the mating housing main body 52.

In the terminal lock structure 31 of the above described constitution, the covered wires W are inserted first into the through holes 14 in the packing member 45 from the back and pulled out forward. After being stripped to expose the cores and positioned inside the wire holders of the terminals 4, the front ends of the wires W are crimped.

A plurality of terminal 4 are inserted into the terminal accommdating chambers 35 of the housing main body 32 from the back till the latch engagement recesses in the terminals 4 are securely engaged with the latches 38. When the covered wires W are pulled backward, the wire holders come to contact with the front end of the packing member 45 and the packing member 45 is inserted to fit into the rear end of the housing main body 32.

When the lock member 42 is inserted from the front of the housing main body 32, the lock retaining plates 41 are pushed inward between the upper surfaces of the latches 38 and the lower surfaces of the upper walls 36, and thus the latches 38 are fastened to be securely engaged in the latch engagement recesses.

If the latches 38 are not securely engaged in the latch engagement recesses in the terminals 4, the lock retaining plates 41 coming in the way hinder insertion of the lock member 42, and thus incomplete insertion of the terminals 4 into the terminal accommodating chambers 35 can be detected.

The terminals 4 are prevented from forward and backward disengagement by the latches 38 and the front walls 39 of the lock member 42 and also prevented from upward disengagement by the upper walls 36 of the terminal accommodating chambers 35. The terminal accommodating chambers 35 are internally sealed by the packing members 45, 55 and 56.

Since the conventional connector terminal lock structure as described above includes flexible latches 38 on the internal surface of the upper walls 36 of the terminal accommdating chambers 35, which can be bent vertically, a problem is the high costs due to the highly complicated metal patterns.

Another problem is that the smaller the aforenamed latches 38 become, the less sufficient the strength becomes.

Still another problem is that the addition in the members by the lock member 42 which includes the lock retaining plates 41 for detection of incomplete insertion of the terminals 4 into the terminal accommdating chambers 35 increases the costs.

SUMMARY OF THE INVENTION

With consideration of the above-described problems, the present invention is to provide a connector terminal lock structure which securely holds the terminals inside the terminal accommdating chambers horizontally and vertically, and which can prevent terminals inserted into the inside of a connector from being incompletely stored in terminal accommdating chambers; wherein water seepage into the terminal accommdating chambers can be positively prevented with a simple structure.

The problems discussed above can be solved by a connector terminal lock structure of the present invention, which consists of a connector housing main body that includes a plurality of terminal accommdating chambers and a cover that covers the aforenamed housing main body wherein terminals are stored, and which includes lock projections provided on inner side wall surfaces of the aforenamed terminal accommdating chambers for prevention of backward disengagement of the aforenamed terminals, a protruding part provided at the front end of a bottom wall of the aforenamed terminal accommdating chambers for prevention of forward disengagement of the aforenamed terminals, and spaces between the aforenamed lock projections and the aforenamed bottom wall whereinto bottom plates of the aforenamed terminals can be inserted for prevention of upward disengagement of the aforenamed terminals.

The connector terminal lock structure of the above-described constitution prevents backward, forward and upward disengagement of the terminals in the terminal accommdating chambers by a simple and rigid structure and positively prevents imperfect insertion of the terminals into the terminal accommdating chambers since click is perceived at the time of complete storage if proper values are selected for the interrelated dimensions of the spaces and the projections. Thus the connector terminal lock structure of high reliability can be provided and, at the same time, the production costs can be reduced.

The problems discussed above can be solved by a connector terminal lock structure of the present invention, wherein the aforenamed lock projections are provided on both sides of the aforenamed side walls so as to confront one another and that front faces of the aforenamed lock projections are formed by squarely and vertically extending the aforenamed side walls.

The connector terminal lock structure of the above-described constitution wherein the lock projections support the terminals positively and strongly can realize a much more highly reliable terminal lock structure.

The problems discussed above can be solved further by a connector terminal lock structure of the present invention, wherein a seal member of elastic material is provided on the rear end of the aforenamed housing main body, which a plurality of through holes for insertion and support of covered wires that are crimped on the aforenamed terminals penetrate and which is engaged to fit into the inside of rear end of the aforenamed cover.

The connector terminal lock structure of the above-described constitution prevents water seepage into the terminal accommdating chambers only with provision of the seal member of the elastic material and thus the simple structure facilitates diversification of the use.

BRIEF DESCRIPTION OF THE PREFERRED EMBODIMENTS

DETAILED DESCRIPTION OF THE PREFERRED EMBODIMENTS

Figure 1:
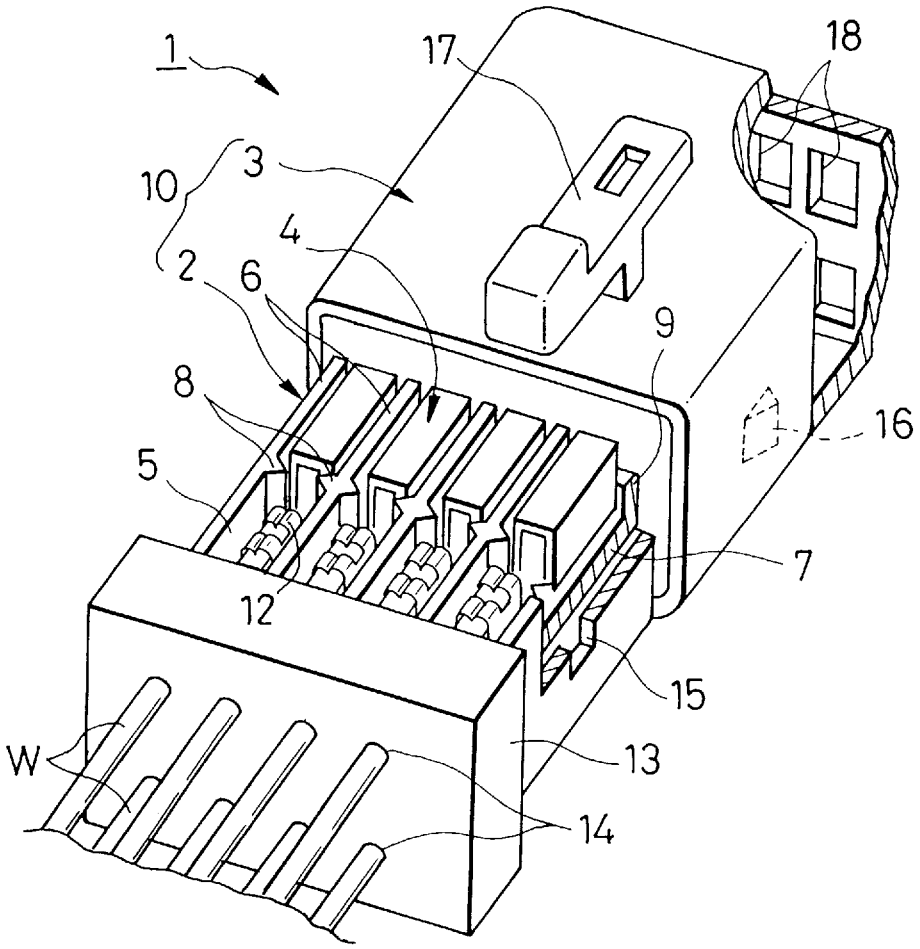
FIG. 1 is a perspective view of an embodiment of the connector terminal lock structure related to the present invention in an intermediate process of assembly.
Figure 2:
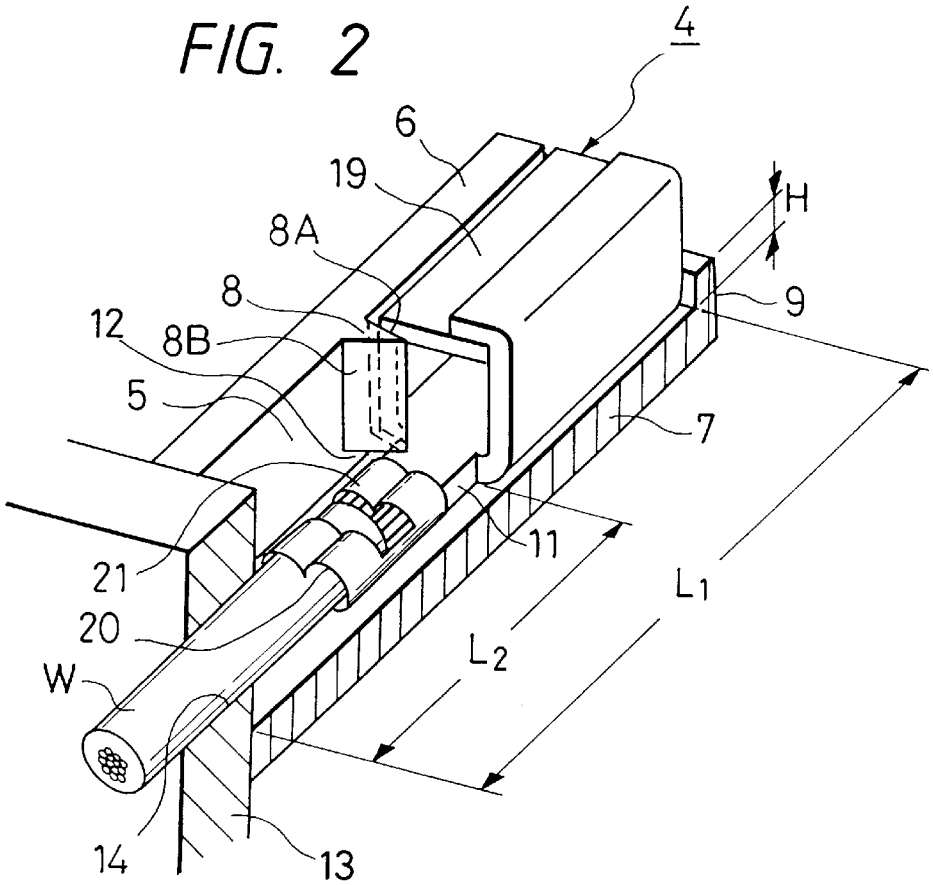
FIG. 2 is a magnified partial perspective view of one of the terminal accommdating chambers in FIG. 1.
Figure 3:
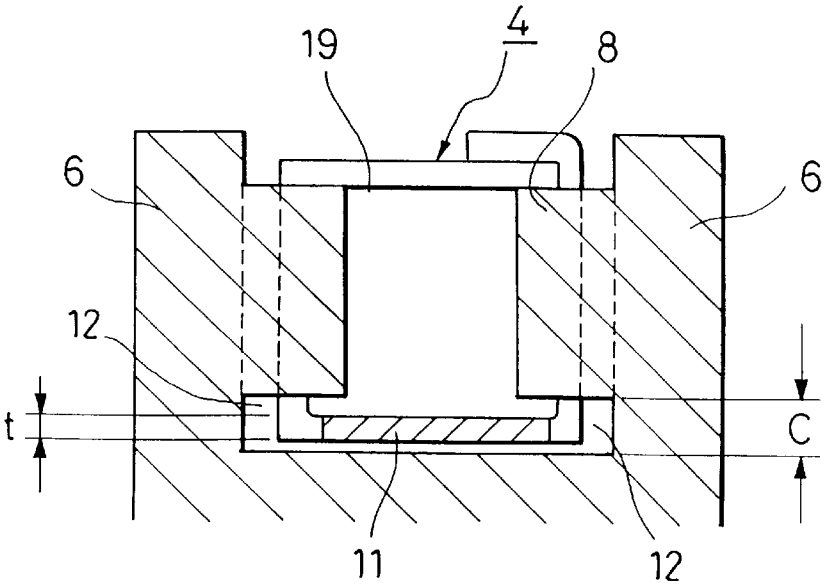
FIG. 3 is a cross-sectional view in FIG. 2.
Figure 4:
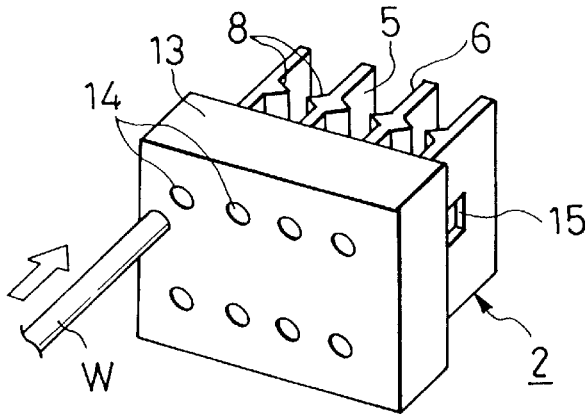
FIG. 4 is an illustrative drawing to show an operational state where the covered wire W is being inserted into the seal member in FIG. 1.
Figure 5:
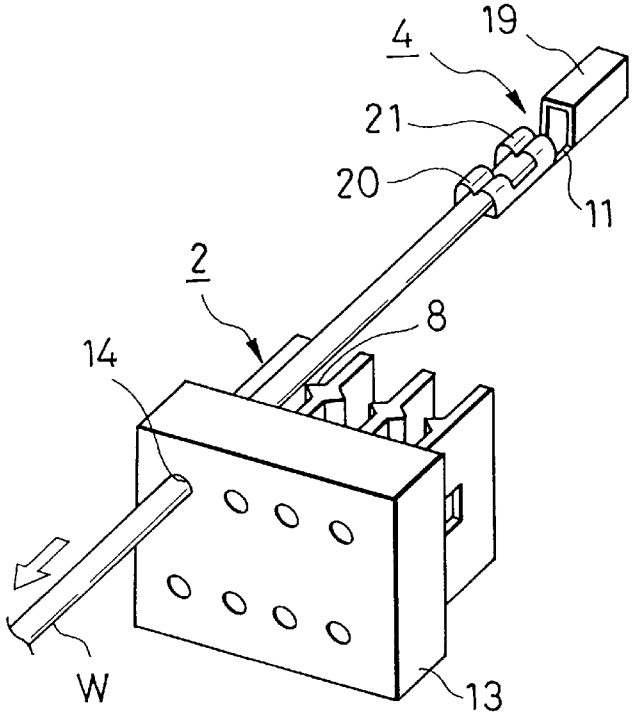
FIG. 5 is an illustrative drawing to show an operational state where the covered wire W in FIG. 4 is being crimped with the terminal.
Figure 6:
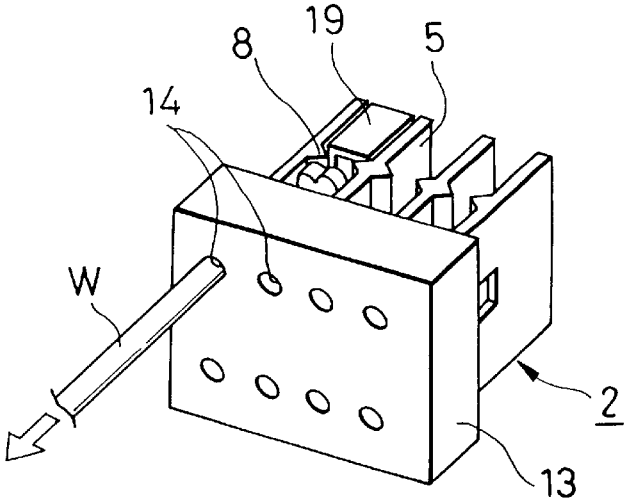
FIG. 6 is an illustrative drawing to show an operational state where the connector terminal in FIG. 5 is being fitted into the housing main body.
Figure 7:
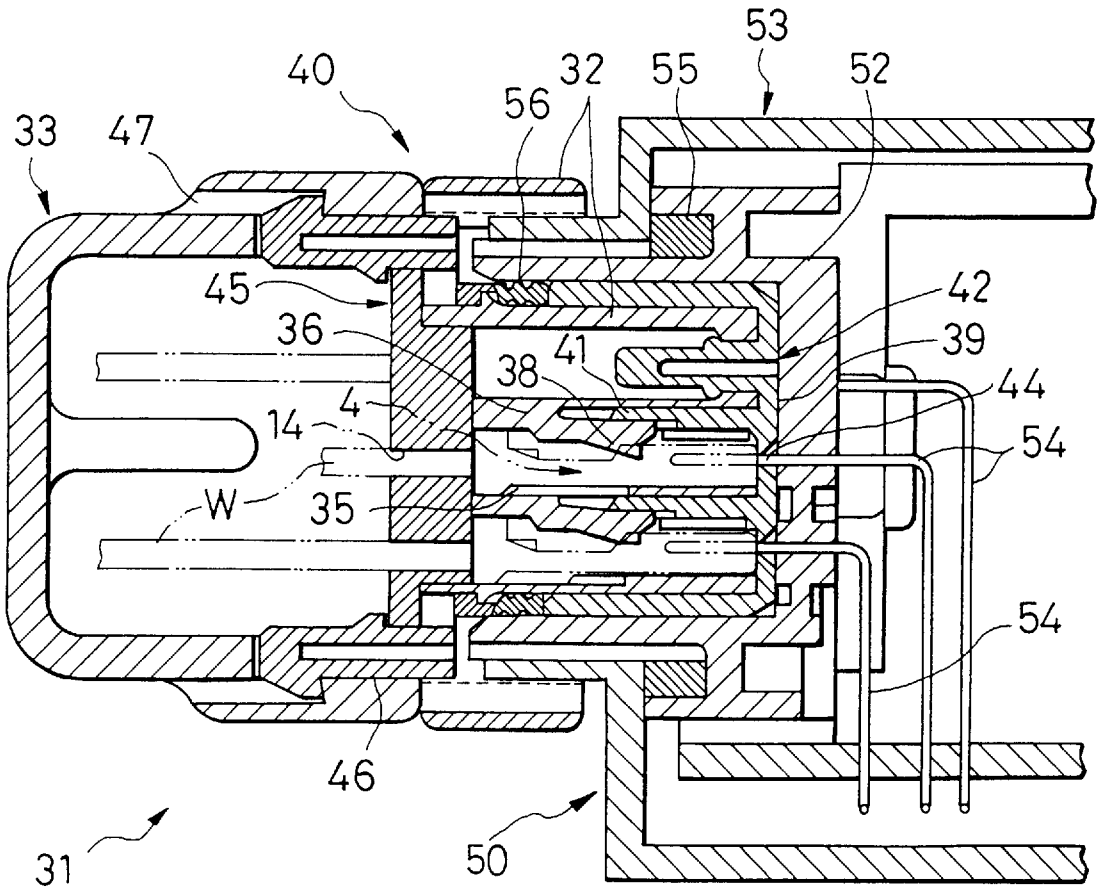
FIG. 7 is a vertical sectional view of the conventional connector terminal lock structure.

An embodiment of the connector terminal lock structure related to the present invention is described below in detail with references to FIGS. 1 through 6. FIG. 1 is a perspective view of an embodiment of the connector terminal lock structure related to the present invention in an intermediate process of assembly; FIG. 2 is a magnified partial perspective view of one of the terminal accommdating chambers in FIG. 1; FIG. 3 is a cross-sectional view in FIG. 2; FIG. 4 is an illustrative drawing to show an operational state where a covered wire W is being inserted into the seal member in FIG. 1; FIG. 5 is an illustrative drawing to show an operational state where the covered wire W in FIG. 4 is being crimped with a terminal; and FIG. 6 is an illustrative drawing to show an operational state where the connector terminal in FIG. 5 is being fitted into the housing main body.

As FIG. 1 shows, the connector terminal lock structure 1 according to the present invention consists of a connector housing main body 2 that includes a plurality of terminal accommdating chambers 5 and a cover 3 that covers the housing main body 2 wherein terminals 4 are stored. Lock projections 8 are provided on the inner surfaces of side walls 6 of the terminal accommdating chambers 5 for prevention of backward disengagement of the terminals 4 and a protruding part 9 is provided at front end of a bottom wall 7 of the terminal accommdating chambers 5 for prevention of forward disengagement of the terminals 4 while spaces 12 are provided between the lock projections 8 and the bottom wall 7 whereinto bottom plates of the terminals 4 can be inserted for prevention of upward disengagement of the terminals 4.

The aforenamed lock projections 8 are provided on both sides of the side walls 6 so as to confront one another and, as FIGS. 2 and 3 show, a front face 8A of the lock projection 8 is formed by squarely and vertically extending the side wall 6. The form of a rear face 8B of the lock projection 8 may be inclined or square to the side wall 6 so long as provided with a sufficient strength to resist the backward disengagement force applied to the terminal 4. The plane figure of the lock projection 8 shown in FIG. 2 is a right-angled triangle.

As FIG. 1 shows, a seal member 13 of elastic material that is provided on the rear end face of the housing main body 2, which a plurality of through holes 14 for insertion and support of the covered wires W that are crimped on the terminals 4 penetrate and which is engaged to fit into the inside of rear end of the cover 3.

To describe more in details, side wall holes 15 for locking the cover 3 are formed on both the side walls of the housing main body 2, and internal projections 16 for engagement with the side wall holes 15 are formed on the inner surfaces of both the side walls of the cover 3. A lock lever 17 is provided on the upper surface of the cover 3 for locking and unlocking a mating female connector (not shown in the figures). A plurality of male terminal guide holes 18 whereinto mating male terminals (not shown in the figures) can be inserted are formed in the front wall of the cover 3.

As FIG. 2 shows, the terminals are female terminals, and contact piece storage cases 19 are formed at the front parts of the bottom plates 11 for connection with the mating male terminals while wire holding parts 20 and 21 are provided in the rear part for crimping to hold covered parts and core wire parts of the covered wires W respectively.

In the embodiment of the above-described constitution, the covered wires 3 are inserted first into the through holes 14 in the seal member 13 from the rear as FIG. 4 shows, and pulled out forward through the terminal accommdating chambers 5.

As FIG. 5 shows, the covered wires W the cores of which are stripped at the front ends are placed and then crimped inside the wire holding parts 20 and 21 of the terminals 4.

Nextly, as FIG. 6 shows, when the covered wires W are pulled backward, the wire holding parts 20 and 21 of the terminals 4 pass through between the lock projections 8 formed on both the side walls 6 inside the terminal accommdating chambers 5 while, as FIGS. 2 and 3 show, the bottom plates 11 pass through the spaces 12 under the bottom ends of the lock projections 8. Since clicks are perceived when the front ends of the bottom plates 11 and the front ends of the contact piece storage cases 19 pass the upper surface of the projections 9 at the front end of the bottom wall 7, complete fitting of the terminals 4 into the terminal accommdating chambers 5 can be detected.

With reference to FIGS. 2 and 3 show, the condition of obtaining the above-described click perception is as below:

The dimension of the space C is required to be a little smaller than the formula:

$$C=(H\times L2/L1)+t$$

Where:

L1: Dimension from the rear end of the projection 9 to the rear end of the bottom wall 7 (length of the terminal storage cavity)

L2: Dimension from the front face 8A of the lock projection 8 to the rear end of the bottom wall 7

H: Height of the projection 9 t: Thickness of the bottom plate 11

C: Height of the space 12

After every terminal 4 is completely stored in each terminal storage cavity 5 as described above, the cover 3 is brought from the front and placed on the housing main body 2. The internal projections 16 on the cover 3 are engaged in the side wall holes 15 on the housing main body 2 to complete the assembly operation of the connector 10.

Since the covered wires W are fitted into the through holes 14 at the same time as the outer rim of the seal member 13 is fitted into the inside of the cover 3, water seepage from the rear of the connector is prevented.

In the connector terminal lock structure of this embodiment, backward disengagement of the terminals 4 is prevented by the rear faces of the contact piece storage cases 19 in contact with the front faces 8A of the lock projections 8 after the terminals 4 are completely stored inside the terminal accommdating chambers 5 with perception of clicks as shown in FIG. 2.

Forward disengagement of the terminals 4 is prevented by the front faces of the contact piece storage cases 19 in contact with the protruding part 9.

Upward disengagement of the terminals 4 is prevented by the bottom surfaces of the lock projections 8 since the bottom plates 11 are inside the spaces i2.

The terminals 4 are securely retained inside the terminal accommdating chambers 5 of a simple structure which does not require complicated metal patterns and prevented from disengagement. Thus a great cost reduction can be realized.

The lock projections 8 and the protruding part 9 of rigid structures prevent the terminals 4 from being disengaged, and thus a highly reliable connector terminal lock structure can be realized with a remarkably improved terminal retaining force.

Moreover, the warterproof condition in the housing is ensured since the seal member is made of an elastic material such as rubber.

The present invention is not restricted to the above embodiment but there may be other embodiments with appropriate modifications. For example, the plane figure of the lock projection 8 in the above embodiment is a right-angled triangle but the figure may be a rectangular shape so long as the strength is sufficient.

As discussed above, the connector terminal lock structure of the present invention includes the lock projections provided on the inner side wall surfaces of the terminal accommdating chambers for prevention of backward disengagement of the terminals, the protruding part provided at the front end of the bottom wall of the terminal accommdating chambers for prevention of forward disengagement of the terminals, and the spaces between the lock projections and the bottom wall whereinto the bottom plates of the terminals can be inserted for prevention of upward disengagement of the terminals.

Therefore, the connector terminal lock structure prevents backward, forward and upward disengagement of the terminals in the terminal accommdating chambers by the simple and rigid structure and positively prevents imperfect insertion of the terminals into the terminal accommdating chambers since clicks are perceived at the time of complete storage if proper values are selected for the interrelated dimensions of the spaces and the projections. Thus the connector terminal lock structure of high reliability can be provided at low costs.

The connector terminal lock structure of the present invention is provided with the lock projections on both sides of the side walls, which confront one another and the front faces of the lock projections are formed by squarely and vertically extending the side walls.

Therefore, the connector terminal lock structure wherein the lock projections support the terminals positively and strongly can realize the much higher reliability.

Moreover, the connector terminal lock structure of the present invention is provided with the seal member of elastic material on the rear end of the housing main body, which a plurality of through holes for insertion and support of covered wires that are crimped on the terminals penetrate and which is engaged to fit into the inside of rear end of the cover.

Therefore, the connector terminal lock structure positively prevents water seepage into the terminal accommdating chambers and thus the simple structure facilitates diversification of the use.

What is claimed is:

1. A connector terminal lock structure comprising:

a connector housing including:

a plurality of terminal accommodating chambers provided with said connector housing;

a cover covering said connector housing into which a plurality of terminals are accommodated;

lock projections, provided on inner side wall surfaces of said terminal accommodating chambers, for prevention of backward disengagement of said terminals;

a protruding portion, provided at front end of a bottom wall of said terminal accommodating chambers, for prevention of forward disengagement of said terminals; and spaces defined between said lock projections and said bottom wall, bottom plates of said terminals being insertable into said spaces such that said lock projections also prevent upward disengagement of said terminals.

2. A connector terminal lock structure claimed in claim 1, wherein said lock projections are provided on both sides of said side walls so as to confront one another, and front faces of said lock projections are squarely and vertically extended from said side walls.

3. A connector terminal lock structure claimed in claim 1, further comprising:

a seal member, made of an elastic member, having a plurality of through holes for penetratingly holding said wire press-fitted on said terminal, said seal member engagingly inserted into an inner side of the rear end portion of said cover, said seal member provided with the rear end portion of the said connector housing.

4. A connector terminal lock structure claimed in claim 1, wherein a height C of said spaces is defined by the following:

$$C=(H\times L2/L1)+t \text{ where:}$$

L1 is a distance from a rear end of said protruding portion to a rear end of said bottom plate;

L2 is a distance from a front face of said lock projections to said rear end of said bottom plate;

H is a height of said protruding portion; and t is a thickness of said bottom plate.

5. A connector terminal lock structure claimed in claim 1, wherein said lock projections each have a v-shape.

6. A connector terminal lock structure claimed in claim 1, wherein said terminals are insertable into said terminal accommodating chambers from a front side of said connector housing.

7. A connector terminal lock structure claimed in claim 6, wherein upon insertion of said terminals into said terminal accommodating chambers said terminals are snapped into place as an indication that said terminals are properly positioned.

8. A connector terminal lock structure claimed in claim 1, wherein a height of said protruding portion is less than a height of a contact piece storage case associated with each of said terminals into which a mating male terminal is receivable.

* * * * *